US012760603B2

(12) United States Patent
Pessanha et al.

(10) Patent No.: US 12,760,603 B2
(45) Date of Patent: Oct. 13, 2026

(54) RUNNING TOOL CARTRIDGE SYSTEM AND METHOD

(71) Applicant: Baker Hughes Energy Technology UK Limited, Bristol (GB)

(72) Inventors: Maurian Paula Pessanha, Rio de Janeiro (BR); Guaraci Vendrame Bornia, Houston, TX (US); Carlos Eduardo Martins Gaban, Rio de Janeiro (BR); Hugo Ferreira Lopes, Houston, TX (US); Philip J. Potter, Houston, TX (US); Daniel Caleb Benson, Houston, TX (US)

(73) Assignee: Baker Hughes Energy Technology UK Limited, Bristol (GB)

( * ) Notice: Subject to any disclaimer, the term of this patent is extended or adjusted under 35 U.S.C. 154(b) by 0 days.

(21) Appl. No.: 19/255,312

(22) Filed: Jun. 30, 2025

(65) Prior Publication Data

US 2026/0009295 A1 Jan. 8, 2026

Related U.S. Application Data

(63) Continuation of application No. 18/766,380, filed on Jul. 8, 2024, now Pat. No. 12,345,100.

(51) Int. Cl.
*E21B 17/02* (2006.01)

(52) U.S. Cl.
CPC ..... *E21B 17/02* (2013.01)

(58) Field of Classification Search
CPC ..... E21B 17/02
See application file for complete search history.

(56) References Cited

U.S. PATENT DOCUMENTS 6,302,211 B1 10/2001 Nelson et al.
8,074,724 B2 12/2011 Minassian et al.
10,648,262 B2 * 5/2020 Tran ..... E21B 23/00
(Continued)

FOREIGN PATENT DOCUMENTS

GB 2573314 B 11/2020
WO 2020071920 A1 4/2020
WO 2023064767 A1 4/2023

OTHER PUBLICATIONS

"Test Plug & Wear Bushing" Brochure, Moto Mecánica Argentina, https://www.motomecanica.com/en/products/onshore-products/wellheads/tools-fittings/test-plug-wear-bushing, printed Jun. 11, 2024, 2 pages.

(Continued)

*Primary Examiner* — Taras P Bemko
(74) *Attorney, Agent, or Firm* — Hogan Lovells Cadwalader US LLP

(57) ABSTRACT

A wellbore system includes a running tool and a cartridge. The running tool includes a slot extending radially into the running tool and a load shoulder. The cartridge is configured to couple to the running tool and circumferentially surrounds the running tool about a tool axis. The cartridge includes an opening extending radially into the cartridge, a coupling slot arranged along an outer profile of the cartridge, and a contact face. The cartridge is positioned on the load shoulder such that the load shoulder blocks axial downward movement of the cartridge along the tool axis and the cartridge is coupled to the running tool via one or more keys extending into both the opening and the slot.

20 Claims, 11 Drawing Sheets

(56) References Cited

U.S. PATENT DOCUMENTS

| | | | | |
|---|---|---|---|---|
| 11,060,383 | B2 | 7/2021 | Twardowski et al. | |
| 2002/0092656 | A1 | 7/2002 | Ford et al. | |
| 2018/0340386 | A1* | 11/2018 | Tran | E21B 31/18 |
| 2020/0318460 | A1 | 10/2020 | Twardowski et al. | |
| 2021/0010340 | A1 | 1/2021 | Queiroz et al. | |
| 2023/0116845 | A1 | 4/2023 | Siwak et al. | |
| 2023/0417111 | A1 | 12/2023 | Stepchinsky et al. | |
| 2024/0117713 | A1 | 4/2024 | Larsen et al. | |

OTHER PUBLICATIONS

Non-Final Office Action issued in U.S. Appl. No. 18/766,380, dated Sep. 16, 2024.
Final Office Action issued in U.S. Appl. No. 18/766,380, dated Dec. 17, 2024.
Notice of Allowance issued in U.S. Appl. No. 18/766,380, dated Feb. 28, 2025.

* cited by examiner

RUNNING TOOL CARTRIDGE SYSTEM AND METHOD

CROSS-REFERENCE TO RELATED APPLICATIONS

This application is a continuation application of and claims priority to U.S. patent application Ser. No. 18/766,380, filed on Jul. 8, 2024, now U.S. Pat. No. 12,345,100, the full disclosure of which is hereby incorporated by reference herein in its entirety for all purposes.

BACKGROUND

1. Field of the Disclosure

The present disclosure relates to wellbore operations. Specifically, the present disclosure relates to systems and methods for replaceable cartridge systems that may be used with one or more running tools for wellbore operations.

2. Description of Related Art

Wellbore operations, such as oil and gas exploration and production, injection, and/or the like, may be conducted in a variety of environments, such as subsea or surface environments, where components are installed on a rig or sea floor. Certain components, either within the wellbore, at the wellbore, or outside of the wellbore, may be tripped into the wellbore and/or removed from the wellbore using one or more running tools. During certain portions of the various operations, the running tool may engage or otherwise contact walls of the wellbore and/or other wellbore components, which may damage portions of the running tool. Replacement running tools are prohibitively expensive and repairing existing tools often involve long lead times, movement of the tools away from the wellsite, and the like, leading to non-productive time, high costs, and delays. Existing approaches to running tool protections do not provide sufficient capacity and/or include components that may be dislodged within the wellbore, causing additional non-productive time to identify and retrieve the components, if possible.

SUMMARY

Applicant recognized the problems noted above herein and conceived and developed embodiments of systems and methods, according to the present disclosure, for running tools.

In an embodiment, a wellbore system includes a running tool and a cartridge. The running tool includes a slot extending radially into the running tool and a load shoulder. The cartridge is configured to couple to the running tool and circumferentially surrounds the running tool about a tool axis. The cartridge includes an opening extending radially into the cartridge, a coupling slot arranged along an outer profile of the cartridge, and a contact face arranged along the outer profile of the cartridge. The cartridge is positioned on the load shoulder such that the load shoulder blocks axial downward movement of the cartridge along the tool axis and the cartridge is coupled to the running tool via one or more keys extending into both the opening and the slot.

In an embodiment, a cartridge for a running tool includes a retrieval shoulder configured to engage one or more wellbore components to remove the one or more wellbore components from a wellbore. The cartridge also includes a coupling slot, axially lower than the retrieval shoulder, configured to receive one or more mating features associated with the one or more wellbore components. The cartridge further includes an opening extending into a body of the cartridge. The cartridge includes a contact surface extending a contact distance from an axis of the cartridge that is larger than a retrieval distance between the retrieval shoulder and the axis of the cartridge and a coupling distance between the coupling slot and the axis of the cartridge. The opening is also configured to receive one or more keys to secure the cartridge to the running tool and the contact surface is a continuous surface formed about the axis of the cartridge.

In another embodiment, a wellbore system includes a running tool and one or more wellbore components to be installed into a wellbore using the running tool. The wellbore system also includes a cartridge configured to couple to the running tool. The cartridge includes an opening extending radially into the cartridge, the opening configured to align with a slot formed in the running tool to couple the cartridge to the running tool. The cartridge also includes a retrieval shoulder arranged along an outer portion of the cartridge to engage at least a portion of the one or more wellbore components to remove the one or more wellbore components from the wellbore. The cartridge further includes a coupling slot configured to couple to one or more features of the one or more wellbore components to install the one or more wellbore components into the wellbore. The cartridge also includes a contact face forming a largest outer diameter of the cartridge and circumferentially surrounding the running tool.

BRIEF DESCRIPTION OF DRAWINGS

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

Figure 1A:
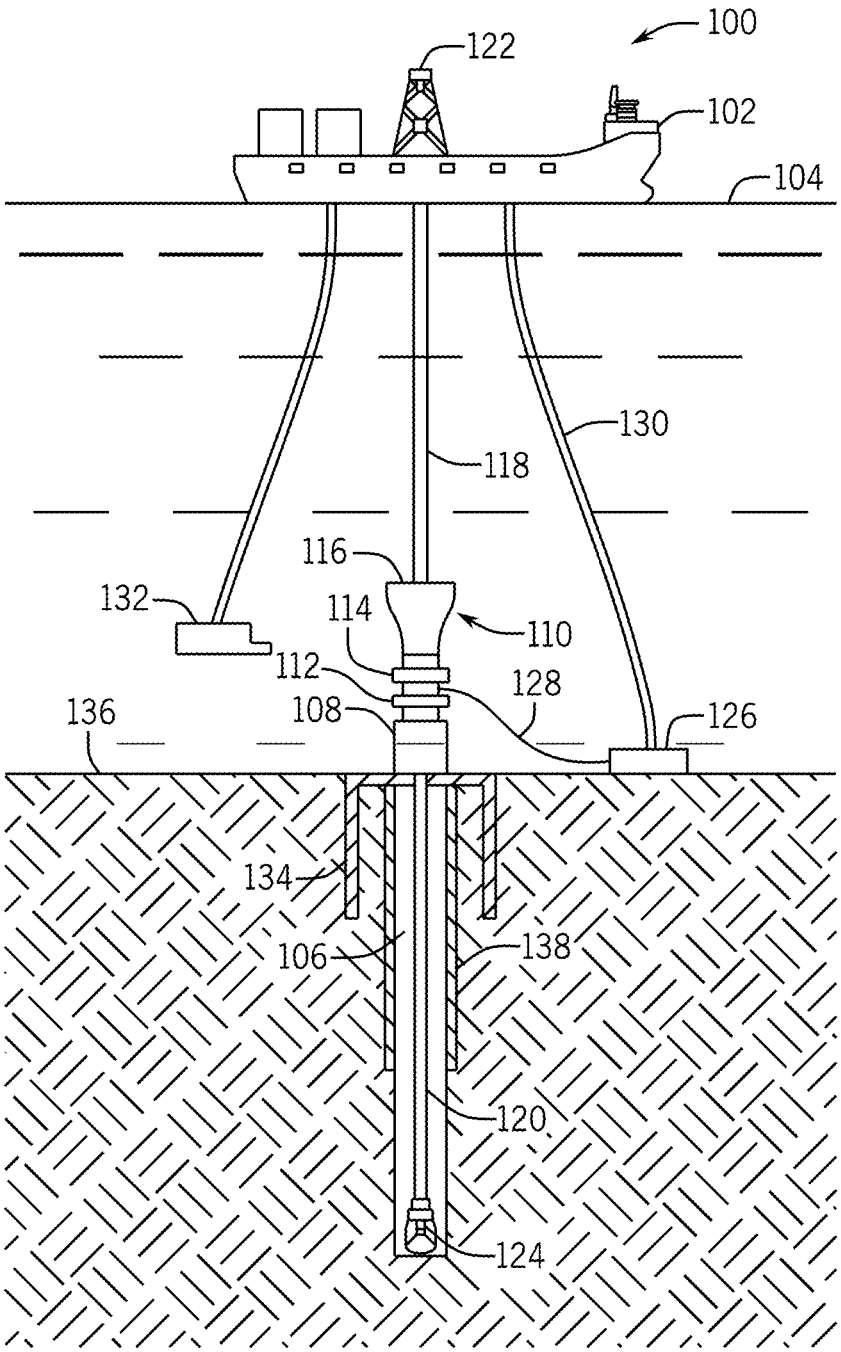
FIG. 1A is a schematic side view of an embodiment of an offshore drilling operation, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. It should be further appreciated that terms such as approximately or substantially may indicate +/−10 percent.

Embodiments of the present disclosure are directed toward systems and methods running tools that may be used to position and/or retrieve one or more components with respect to a wellbore, such as a subterrain wellbore. In at least one embodiment, a removable, replaceable, and/or repairable cartridge system may be coupled to a running tool to serve as a sacrificial and/or protective component during installation and/or removal. Various embodiments may include one or more retrieval and/or supportive segments in order to secure a component to the running tool, via, at least in part, the cartridge, place the component within the wellbore, disengage the component from the running tool, and/or resecure the component to the running tool for retrieval from the wellbore. Systems and methods may include a cartridge in the form of an annular ring, which may be a continuous component that does not include breaks and/or segments. Various embodiments may also include one or more segments, such as segments that are coupled together via one or more fasteners, interlocking components, and/or the like. The cartridge may be installed at a particular location of the running tool at a surface location and then secured via one or more keys, which may be positioned using various fasteners, as one example. The cartridge may be arranged on a load shoulder of the running tool in order to accommodate a variety of downhole forces applied to the running tool during one or more of installation or retrieval operations. In at least one embodiment, the cartridge includes a greater outer diameter than a running tool outer diameter, and as a result, one or more regions of the cartridge may engage wellbore walls instead of the running tool, thereby providing a sacrificial or otherwise preferentially damaged component with respect to the running tool. One or more surfaces may be treated or otherwise prepared for such wellbore wall contact, for example, by hard facing or applying one or more coatings or covers. Upon identification of damage, the cartridge may be removed from the running tool and replaced with a new cartridge and/or repaired. In this manner, systems and methods may reduce a likelihood of damage to the running tool, which is a more expensive and more challenging to repair component than the cartridge, which may reduce non-productive time and/or reduce costs associated with various wellbore operations.

In at least one embodiment, the cartridge may include an outer profile having one or more different outer diameters. A larger outer diameter may include one or more sacrificial or contact surfaces that extend radially outward (relative to an axis of the cartridge/running tool) to a radial position that is greater than an outer diameter of the running tool. As a result, the larger outer diameter portion will preferentially contact the wellbore walls during trips in/out of the wellbore, protecting the running tool from contact with the wellbore walls. Systems and methods may also include the cartridge with different keys and/or shoulders in order to receive and/or centralize various wellbore components for installation and/or to retrieve one or more wellbore components. In this manner, the cartridge may be used during a variety of operations by adjusting one or more portions of the outer profile and/or tailoring different inner profiles for various components. In at least one embodiment, the cartridge may include an orifice and/or opening that receives one or more keys that may be used to secure the cartridge to the running tool. The keys may include different edges, extensions, arms, shoulders, and/or the like to facilitate connection with the running tool. While certain embodiments may include mechanical fasteners to secure the keys to the running tool, in at least one embodiment, the key configurations with respect to a slot within the running tool may receive and/or accommodate different downhole forces, and as a result, the fasteners, when used, may not be the only components used to resist or otherwise overcome the downhole forces. Systems and methods may provide a replaceable cartridge that can be installed and/or removed at a wellsite, such as at a rig, with minimal tooling and/or equipment, thereby facilitating rapid installation and/or removal.

Embodiments of the present disclosure may address and overcome problems with existing systems. For example, various existing tools provide full-body integrated systems within the running tool. These systems are expensive because, when damaged, the entire running tool is taken out of service for repairs and/or replacement. As a result, costs may increase due to non-productive time, shipping running tools between well sites and shops, and/or the like. Other systems may incorporate "blades" or other sacrificial components, but these are often segmented portions that are coupled via fasteners. The segmented design lacks the proper capacity for numerous downhole applications and, moreover, the coupling systems often fail, thereby causing portions of the blades to remain within the wellbore. The blades may damage sealing surfaces and/or become stuck or lodged within the wellbore, leading to additional operations to locate and recover the blades. If the blades cannot be recover, additional remediation operations may be needed, such as drilling through components, deviating the wellbore, or abandoning the well. These undesirable outcomes are addressed and solved by embodiments of the present disclosure that may include a full circumference, annular cartridge. The cartridge may include a variety of different contact surfaces, but as discussed herein, may include an outer diameter portion that exceeds an outer diameter of the running tool, thereby reducing a likelihood of damage to the running tool. Similarly, the annular or single form component may address and overcome problems with the blades may having an increased operational capacity and a reduced likelihood of removal from the running tool. Accordingly, embodiments of the present disclosure overcome existing drawbacks with tools by providing an easier to manufacture, cheaper, and improved system.

Systems and methods are directed toward a cartridge system that may be replaced and/or repaired with reduced costs when compared to a running tool, among other wellbore components. In at least one embodiment, the cartridge system is configured for a given capacity that may exceed capacities with existing solutions, such as segmented blades, by forming a unitary annular component that may be secured to the running tool with one or more keys. In at least one embodiment, the one or more keys may be configured to receive the loading associated with the use of the cartridge system. For example, the one or more keys may include features that are used to receive tension and rotational forces. An outer profile of the cartridge may be particularly selected to mate with other components associated with the wellbore and/or to extend radially outward farther than the running tool in order to preferentially contact the wellbore wall during installation and removal operations. In this manner, systems and methods may provide a replaceable cartridge with hard facing application for a running tool associated with one or more wellbore operations. The cartridge may provide a 360 degree contact with the formation (e.g., the wellbore wall), providing smooth rotation when drilling the well and may further be replaced as needed, either at the shop or in the field, due to excessive wear of the cartridge (e.g., wear above a threshold). Accordingly, systems and methods may be directed toward a compact design, low cost cartridge with and simpler manufacturing and maintenance processes.

FIG. 1A is a side schematic view of an embodiment of a subsea drilling operation 100. It should be appreciated that one or more features have been removed for clarity with the present discussion and that removal or inclusion of certain features is not intended to be limiting, but provided by way of example only. Furthermore, while the illustrated embodiment describes a subsea drilling operation, it should be appreciated that one or more similar processes may be utilized for surface applications and, in various embodiments, similar arrangements or substantially similar arrangements described herein may also be used in surface applications. Additionally, in at least one example, the subsea operation may be referred to as a shallow-water system. Furthermore, a drilling application is provided as a non-limiting example and various systems or methods could also be used in other applications, including recovery, inspection, data collection, and/or the like. The drilling operation includes a vessel 102 floating on a sea surface 104 substantially above a wellbore 106. As noted, the vessel 102 is for illustrative purposes only and systems and methods may further be illustrated with other structures, such as floating/fixed platforms, and the like. A wellbore housing 108 sits at the top of the wellbore 106 and is connected to a blowout preventer (BOP) assembly 110, which may include shear rams 112, sealing rams 114, and/or an annular ram 116. One purpose of the BOP assembly 110 is to help control pressure in the wellbore 106. The BOP assembly 110 is connected to the vessel 102 by a riser 118. During drilling operations, a drill string 120 passes from a rig 122 on the vessel 102, through the riser 118, through the BOP assembly 110, through the wellhead housing 108, and into the wellbore 106. It should be appreciated that reference to the vessel 102 is for illustrative purposes only and that the vessel may be replaced with a floating/fixed platform or other structure. The lower end of the drill string 120 is attached to a drill bit 124 that extends the wellbore 106 as the drill string 120 turns. Additional features shown in FIG. 1 include a mud pump 126 with mud lines 128 connecting the mud pump 126 to the BOP assembly 110, and a mud return line 130 connecting the mud pump 126 to the vessel 102. A remotely operated vehicle (ROV) 132 can be used to make adjustments to, repair, or replace equipment as necessary. Although a BOP assembly 110 is shown in the figures, the wellhead housing 104 could be attached to other well equipment as well, including, for example, a tree, a spool, a manifold, or another valve or completion assembly.

One efficient way to start drilling a wellbore 106 is through use of a suction pile 134. Such a procedure is accomplished by attaching the wellhead housing 108 to the top of the suction pile 134 and lowering the suction pile 134 to a sea floor 136. As interior chambers in the suction pile 134 are evacuated, the suction pile 134 is driven into the sea floor 136, as shown in FIG. 1, until the suction pile 134 is substantially submerged in the sea floor 136 and the wellhead housing 108 is positioned at the sea floor 136 so that further drilling can commence. As the wellbore 106 is drilled, the walls of the wellbore are reinforced with concrete casings 138 that provide stability to the wellbore 106 and help to control pressure from the formation. It should be appreciated that this describes one example of a portion of a subsea drilling operation and may be omitted in various embodiments. In at least one embodiment, systems and methods of the present disclosure may be used for drilling operations that are completed through a BOP and wellhead, where a casing hanger and string are landed in succession. As noted above, configurations with respect to a sea floor or any offshore application are for illustrative purposes and embodiments of the present disclosure may also be utilized in surface drilling applications.

Figure 1B:
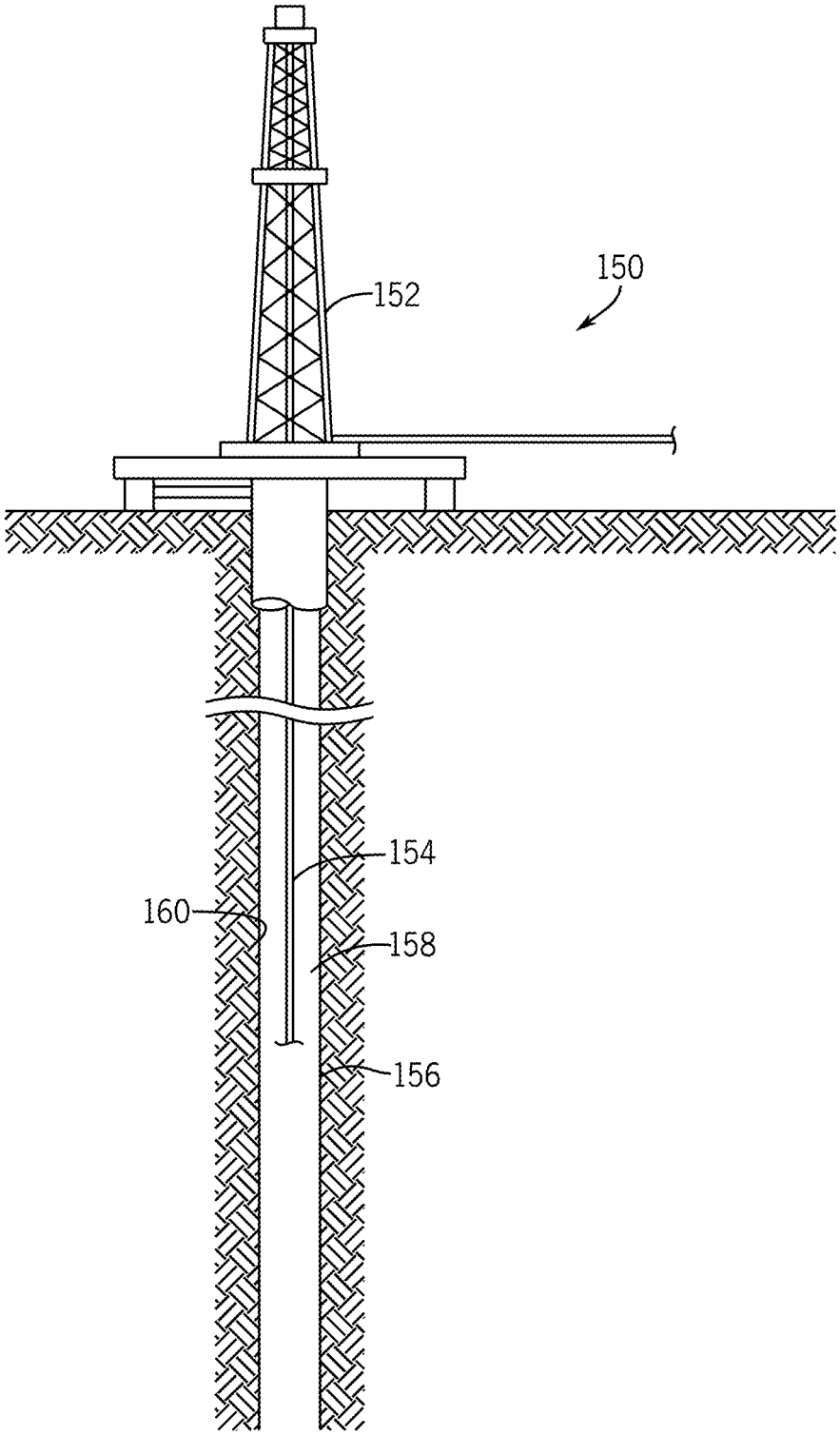
FIG. 1B is a cross-sectional side view of an embodiment of a wellbore system, in accordance with embodiments of the present disclosure.

FIG. 1B is a schematic side view of an embodiment of a wellbore system 150, which may include a completion system, a recovery system, or a drilling system. In this example, the wellbore system 150 a rig 152 and a string 154 coupled to the rig 152. The string 154 may extend through a wellhead assembly (not pictured) such as a blowout preventer (BOP) and/or one or more valve configurations. The wellhead assembly may be a surface assembly, which is not visible in the illustrated embodiment due to a platform of the rig 152, but it should be appreciated that it may be provided in various embodiments. Systems and methods may be utilized in embodiments where one or more completion or recovery operations are initiated, such as when the string 154 is suspended into a wellbore 156. For example, the string 154 may include a running tool at an end (not pictured) to trip different components into the out of the wellbore, for example, during different phases of a wellbore lifecycle. In this example, the string 154 may be a completion or production string, which may include one or more tubulars coupled together and suspended from one or more features, such as the wellhead assembly and/or a casing/tubing hanger, among other options. It should be appreciated that the string 154 may also be a casing string, where one or more cementing operations may be used to cement and secure the string 154 to a wellbore wall. Furthermore, various embodiments may also implement such configurations during drilling operations, where the string 154 includes a drill bit at an end.

In this example, the string 154 is suspended into an annulus 158 formed between the string 154 and a wellbore wall 160. The string 154, as noted above, may be secured to one or more assemblies that are configured to receive and support the string 154, such as a hanger assembly. In operation, the hanger assembly may be arranged within the wellbore 156, or at a surface location, and may include one or more seals to control pressure within the wellbore. Embodiments of the present disclosure may be incorporated with one or more of exploration, drilling, completion, and/or recovery efforts associated with subsea and/or surface applications. Furthermore, embodiments may also be used with various intervention or injection operations, among other uses for wellbores.

Various embodiments of the present disclosure incorporate one or more cartridges that may be used with different wellbore components, such as running tools, in order to reduce a likelihood of damage to the running tool during different tips into and/or out of the wellbore. By way of example, the cartridge may be a removable component that may be installed at a rig or surface location and then secured to the running tool. The running tool may then be used to engage a component for installation and/or engager an component for retrieval. In at least one embodiment, the cartridge may include a profile and/or features to facilitate recovery and/or installation while including an outer diameter portion that is preferentially positioned to engage the wellbore bore during operations to reduce a likelihood of damage to the running tool itself.

Figure 2A:
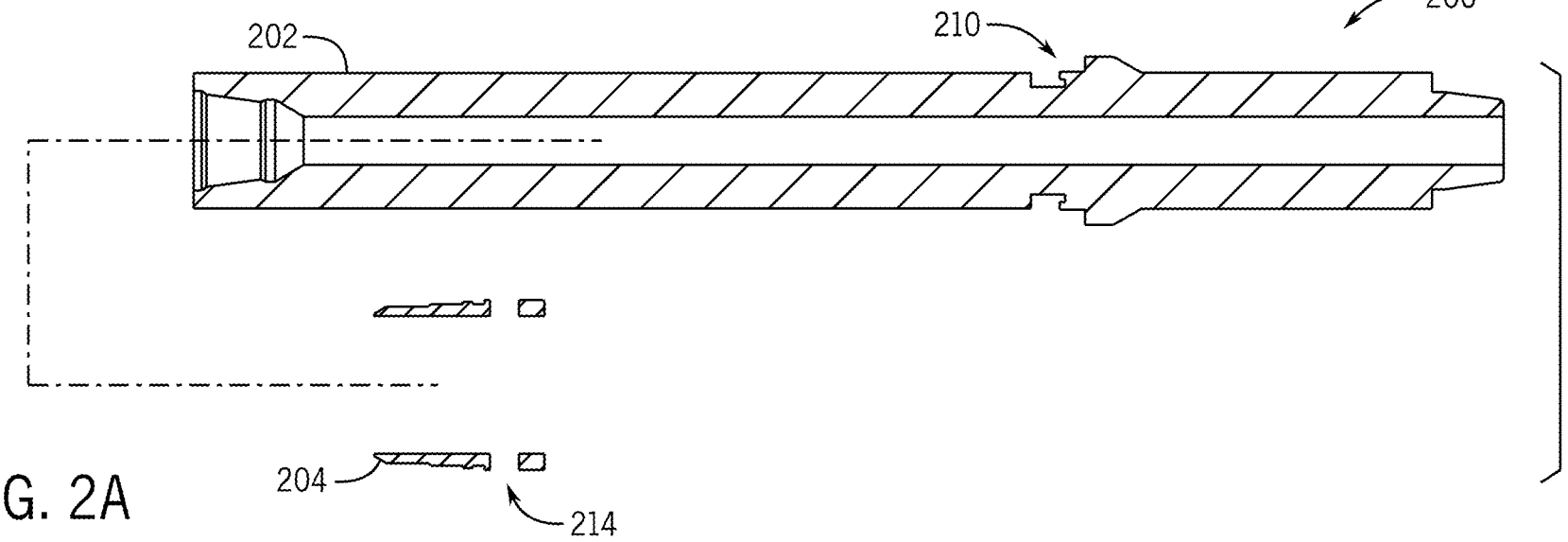
FIG. 2A illustrates an exploded cross-sectional view of an embodiment of a running tool and cartridge, in accordance with embodiments of the present disclosure.
Figure 2B:
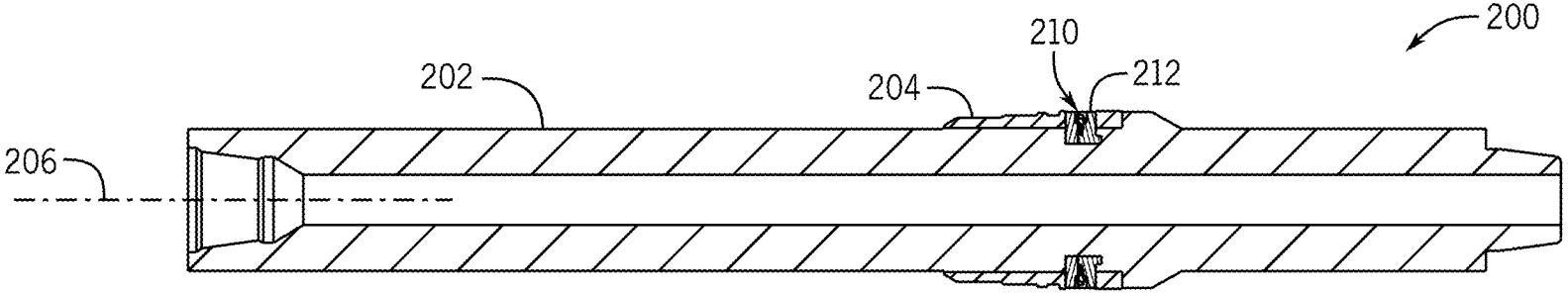
FIG. 2B illustrates a cross-sectional view of an embodiment of a running tool and cartridge coupled together, in accordance with embodiments of the present disclosure.

FIGS. 2A and 2B are cross-sectional views of an embodiment of a bit run running tool (BRRT) system 200 that may be used with embodiments of the present disclosure. In this example, FIG. 2A includes an exploded view in which a running tool (RT) 202 is configured to receive a cartridge 204. The illustrated cartridge 204 may be arranged circumferentially about the RT 202, as shown in FIG. 2B, to form the system 200 in which the RT 202 and the cartridge 204 are axially aligned about a tool axis 206. In other words, respective axes of the RT 202 and the cartridge 204 may be aligned when the cartridge 204 is positioned on and/or secured to the RT 202.

In this example, the cartridge 204 is positioned at cartridge shoulder 208 of the RT 202. The illustrated cartridge shoulder 208 may correspond to a widest part of the RT 202. For example, the cartridge shoulder 208 may include a cartridge shoulder diameter that is larger than other portions of the RT 202, such as a body portion, as discussed herein. The RT 202 further includes slots 210 to receive one or more keys 212 that may be inserted through openings 214 in the cartridge 204 when the openings 214 are aligned with the slots 210. It should be appreciated that the slots 210 may be a continuous annular slot in various embodiments, however, in at least one embodiment, individual slots 210 may be arranged to receive individual keys 212. Slots 210 may be positioned at a variety of locations and there may be any reasonable number of slots 210, such as one slot 210, two slots 210, three slots 210, four slots 210, and/or the like. In certain embodiments, there may be between two and five slots 210. In various embodiments, there may be slots at different axial positions along a length of the RT 202, such that one set of slots is offset (e.g., at a different circumferential position) than the other set of slots.

During installation, which may occur at a well site, such as at a rig, the cartridge 204 may be positioned such that the axes align and then may be slide along a body of the RT 202 until the cartridge 204 is positioned on the cartridge shoulder 208. The cartridge 204 and/or the RT 202 may then be rotated such that the openings 214 align with the slots 210, thereby permitting the keys 212 to be positioned through the openings 214 and into the slots 210, which may secure the cartridge 204 to the RT 202. In this manner, systems and methods may provide a cartridge 204 that circumferentially surrounds the RT 202. As discussed herein, one or more portions of the cartridge 204 may have a greater outer diameter to selectively contact the wellbore wall during installation and/or removal, thereby reducing a likelihood of damage to the RT 202. Moreover, portions of the cartridge 204, such as different locations along a profile, may be used to engage different wellbore components for installation, retrieval, and/or the like.

Figure 3:
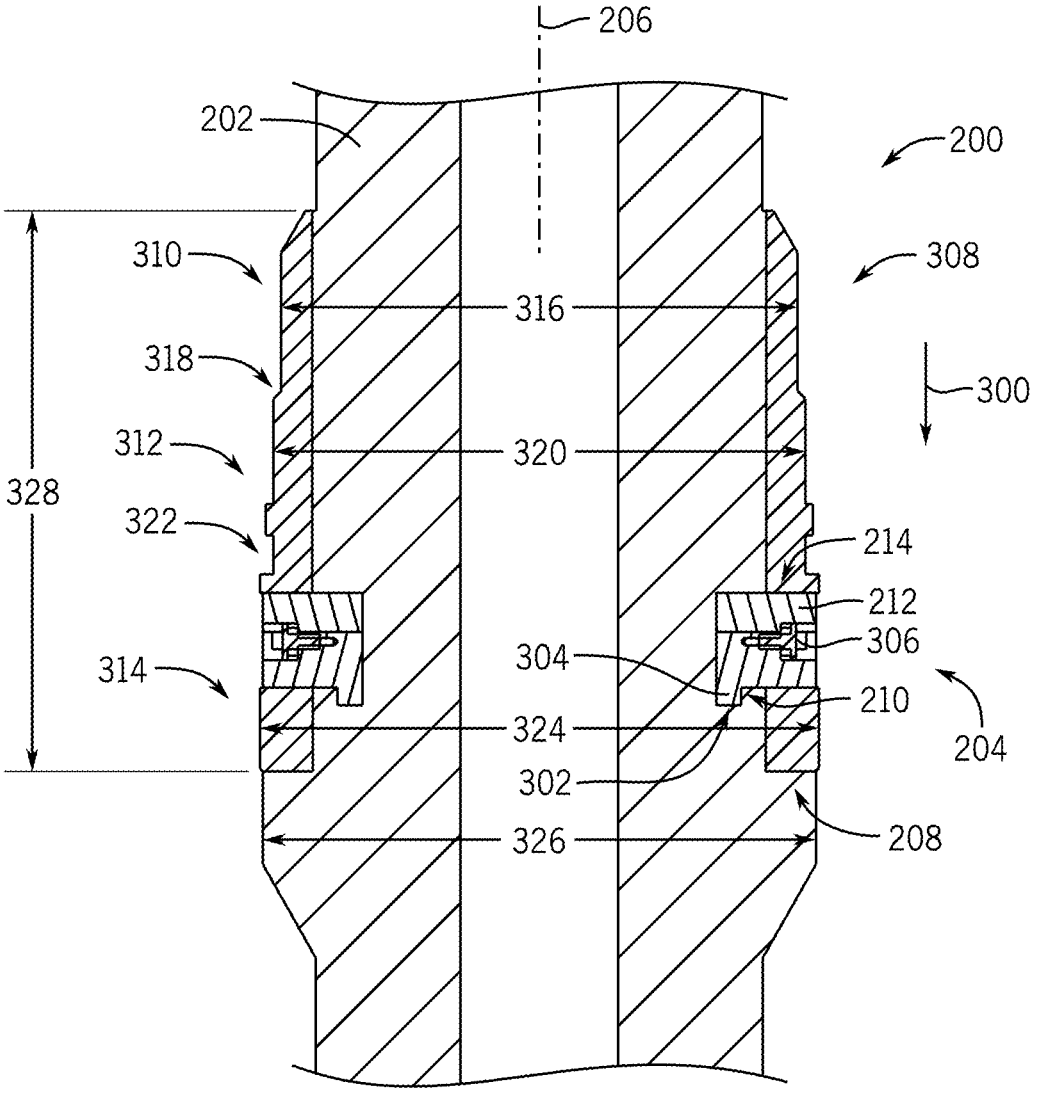
FIG. 3 illustrates a cross-sectional view of an embodiment of a cartridge secured to a running tool using one or more keys, in accordance with embodiments of the present disclosure.

FIG. 3 illustrates a cross-sectional view of an embodiment of the BRRT 200 in which the cartridge 204 is secured to the RT 202 using the one or more keys 212. In this example, the cartridge 204 is positioned on the cartridge shoulder 208 such that axial movement of the cartridge 204 along the axis 206 in a downward direction 300 is blocked. Not only does the cartridge shoulder 208 block the movement, but the position of the one or more keys 212 may also serve to block movement of the cartridge 204, both along the axis 206, rotationally, radially, and/or torsionally. Accordingly, systems and methods of the present disclosure may be used to lock the cartridge 204 in place to prevent upward movement, downward movement, and rotational movement. As discussed herein, the one or more keys 212 may be secured to the RT 202 to block upward and/or downward movement along the axis 206 due to the one or more keys 212 blocking movement of the cartridge 204 due to the extension of the one or more keys 212 through the openings 214 and the slots 210, which are illustrated as being aligned such that the one or more keys 212 extend through the aligned arrangement, thereby blocking movement of the cartridge 204 along the axis. Furthermore, as discussed herein, the one or more slots 210 and/or the one or more openings 214 may have a defined region or size such that rotational movement of the cartridge 204 is also blocked.

As shown in this example, the one or more keys 212 extend through both the openings 214 and the slots 210, which as arranged in an aligned position to permit access to the keys 212. The slots 210 further include a recess 302, which receive arms 304 of the keys 212. The inclusion of the recess 302 and arm 304 combination may reduce stresses or reliance on one or more fasteners 306 used to secure the keys 212 to the RT 202. It should be appreciated that the fasteners 306 are provided by way of non-limiting example and that other embodiments may remove the fasteners 306 and/or incorporate additional coupling systems, such as press fits, interference fits, spring-based fits, locking members, bayonet connections, and/or the like. For example, the keys 212 may include radially extending fingers that rotate to block removal of the keys 212 from the slots 210. As another example, the keys 212 may include retractable dogs, for example loaded by springs, that engage additional portions of the slots 210. In this manner, a variety of different fasteners and/or fastening configurations may be used to secure the keys 212 to the RT 202. Similarly, the illustrated geometry of the keys 212 is also provided by way of non-limiting example. In other embodiments, the keys 212 may include or omit various components, such as the arms 304 and/or the like. For example, the arms 304 may be included at both an upper and lower portion of the keys 212. As another example, the arms 304 may be spring-loaded or otherwise forced out of a body of the keys 212. Furthermore, different embodiments may include keys 212 with different shapes and/or opening configurations, which may be used to particularly align the cartridge 204 at certain areas of the RT 202.

In at least one embodiment, the keys 212 may be coupled to the RT 202 using multiple fasteners, and/or a first fastener may be used to secure key components to one another while a second fastener is used to secure the combined key components to the RT 202. Systems and methods may also include a multi-component key that may slide or otherwise be positioned within the slots 210. For example, the key may include a base component that includes a downward extending arm. A first facing component may couple to the base component while a second facing component couples to the base component in an axially different position. The second facing component may also include an arm or a slot that enables the second facing component to be arranged within the slot 210 such that radially outward axial movement (with respect to the axis of the tool) is blocked by the slot 210. Systems and methods may also include a moveable second facing component that is not secured to the base component, but instead, may be wedged or otherwise maintained in its position using one or more fasteners or the like blocking axial movement. Accordingly, systems and methods may provide a key 212 configuration that blocks radial, axial, and rotational movement of the cartridge 204.

Various embodiments of the present disclosure may provide different coupling configurations to facilitate attachment of the cartridge 204 to the RT 202 such that radial, axial, and rotational forces are blocked using features of the cartridge 204 and/or the keys 212, thereby reducing reliance on various threaded fasteners, which may provide for improved loading configurations. In at least one embodiment, the keys 212 may be installed within the slot 210 and then secured to the RT 202 via one or more fasteners. However, as discussed herein, various geometric features of the keys 212 may be used to block or otherwise resist external forces acting on the cartridge 204. In at least one embodiment, the keys 212 may include one or more components, where the components may be secured directly together and/or may be placed within the slot 210 in an interfering or otherwise blocking configuration. In at least one embodiment, the keys 212 may be installed within the slot 210 such that one or more extensions are positioned within an associated slot or depression formed in the slot, which may block radial movement (e.g., outward from the axis) due to contact between the key body and the cartridge 204. Additionally, one or more embodiments may further include a key insert that may be positioned within the slot 210. The key insert may be described as having an "L" configuration in which the key insert is positioned within the slot so that radial movement of the key insert blocked by the cartridge 204. In at least one embodiment, the key insert may be installed within the slot 210 and the slid axially along the key body, where a fastener or otherwise feature may be installed to block downward axial movement of the key insert, thereby securing the key insert within a second recess. In this manner, radial forces against the key 212 may be applied to each of the key body extension arm and the key insert, which may further reduce the stresses applied to the fasteners and/or other features used to secure the key 212 to the RT 202.

Embodiments of the present disclosure further include a profile 308 associated with the cartridge 204, which in this example is an annular cartridge that circumferentially surrounds the RT 202. As discussed herein, the cartridge 204 may be a unitary piece in at least one embodiment, but it should be appreciated that other embodiments may include segments coupled together. The illustrated profile 308 is a stepped profile that includes different diameters at different axial positions of the cartridge 204. For example, the cartridge 204 extends for an axial length 328 along the axis 206 and includes a top profile 310, a middle profile 312, and a bottom profile 314. The top profile 310 may correspond to a relief formed at a top end of the cartridge 204 and includes a slanted region and an axial extension. The slanted region may be formed to facilitate movement of the RT 202, for example to permit movement through different wellbore components and the like. In this example, the slanted region causes the top profile 310 to have a variable diameter from a top to a bottom of the slant. As discussed herein, a top diameter 316 may refer to an outer diameter at a bottom of the slant.

Further illustrated is the middle profile 312, which includes a retrieval shoulder 318 used to capture and remove one or more wellbore components, such as a wear bushing assembly discussed herein. The retrieval shoulder 318 also includes a slanted face that extends to a middle diameter 320, which is larger than the top diameter 318. The middle profile 312 also includes a coupling slot 322 with a profile configuration to engage one or more wellbore components, such as a wear bushing assembly discussed herein as one example. In this configuration, the coupling slot 322 includes variable diameters. The bottom profile 314 includes the openings 214 and also includes a bottom diameter 324, which is larger than both the top diameter 316 and the middle diameter 320. Furthermore, the bottom diameter 324 is larger than a tool diameter 326. As discussed herein, the larger bottom diameter 324, compared to the tool diameter 326 correspond to a further outward radial position of the cartridge 204 (relative to the axis 206), and as a result, during operations, the wellbore bore will engage the cartridge 204 at the bottom diameter 324 prior to engaging the RT 202 at the tool diameter 326, thereby reducing a likelihood of damage to the RT 202. In at least one embedment, the bottom diameter 324 may include a hard facing or other surface preparation to further resist damage due to contact with the wellbore wall.

Figure 4A:
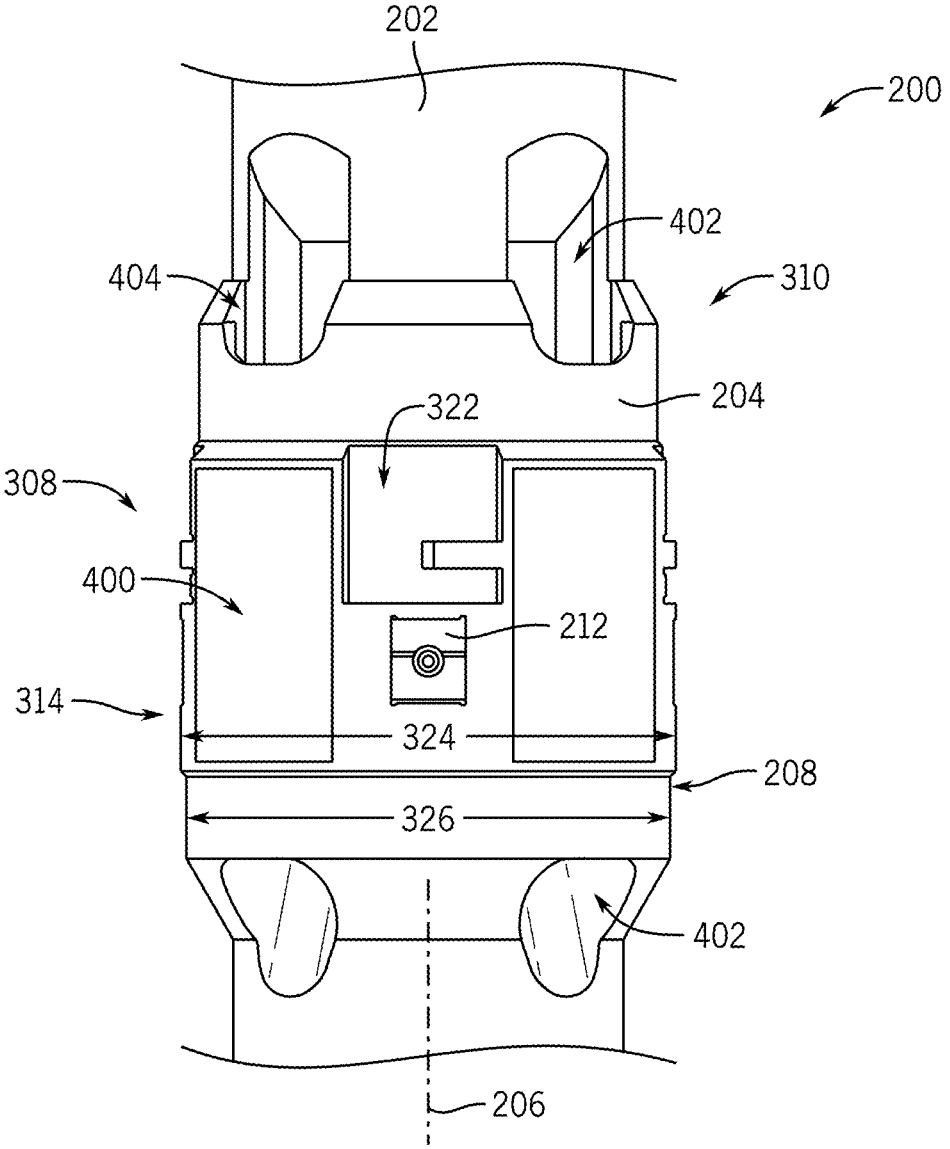
FIG. 4A illustrates a front perspective view of an embodiment of a cartridge secured to a running tool using one or more keys, in accordance with embodiments of the present disclosure.
Figure 4B:
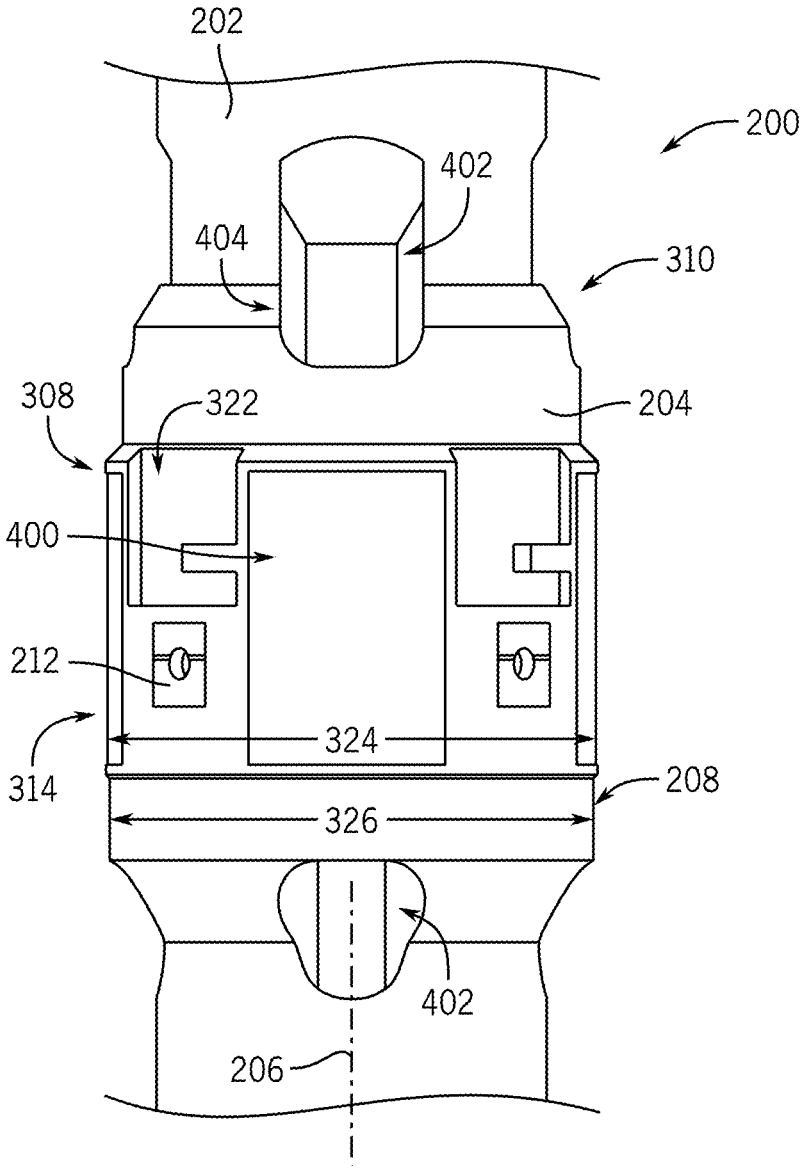
FIG. 4B illustrates a side perspective view of an embodiment of a cartridge secured to a running tool using one or more keys, in accordance with embodiments of the present disclosure.

FIGS. 4A and 4B illustrate front and side perspective views of embodiments of the BRRT 200 including the RT 202 and cartridge 204 coupled together via the keys 212. In the example of FIG. 4A, the profile 308 is visible as extending radially outward from the top profile 310 to the bottom profile 314. Moreover, the larger bottom diameter 324 compared to the tool diameter 326 is also visible in FIGS. 4A and 4B, illustrating how the cartridge 204 protects the RT 202 from contacting wellbore walls during operation.

In the configuration of FIG. 4A, the coupling slot 322 is illustrated between two pairs of contact surfaces 400, which may be associated with different facing or finishing operations, such as hard facing. It should be appreciated that the delineation/specific regions for the contact surfaces 400 is by way of non-limiting example and a continuous surface may be present associated with the bottom diameter 324. In other words, one or more embodiments may have a constant or continuous material, with the same coating and/or surface preparations, and the contact surfaces 400 are provided for clarity. As shown, the coupling slot 322 and the key 212 are positioned between the contact surface 400 and axially stacked. The configuration is provided as one example and the coupling slot 322 and the key 212 may be reversed such that the key 212 is axially higher than the coupling slot 322. Additionally, in at least one embodiment, the key 212 may also be incorporated into and/or overlap a portion of the contact surfaces 400 such that the openings 214 are formed in the areas with the contact surface 400.

As discussed herein, the particular configuration of features such as the contact surface 400, coupling slot 222, and/or the respective openings/slots 214,210 for the keys 212 are provided as examples and are not intended to limit the scope of the present disclosure. For example, the coupling slot 222 shown has a "c"-type configuration, but various other embodiments may include different shapes, sizes, and/or the like. For example, a "t"-slot may be used along with a "j"-slot or any other reasonable shape. Accordingly, in at least one embodiment, the coupling slot 322 and its resultant geometry may be particularly selected in order to mate with or otherwise interact with one or more features of an associated wellbore component, such as dogs or the like, as discussed herein. Similarly, different configurations for the keys 212 may also be used based on one or more design considerations.

The illustrated configuration of FIG. 4A further illustrates flow by passages 402 that extend from a position axially lower than the cartridge shoulder 308, through the cartridge shoulder 308, through the cartridge 204, and then terminate axially above the cartridge 204. In at least one embodiment, the flow by passages 402 may be formed into the RT 202. In this example, the cartridge 204 includes flow paths 404 that are aligned with the flow by passages 402, which may be particularly positioned to further align the slots 210 with the slots 214 to facilitate coupling using the keys 212. The flow by passages may permit flow of fluids, such as mud or other wellbore fluids during operations. Different shapes may be included for the flow paths 404 and the oval/rounded configuration in FIG. 4A is shown by way of example.

FIG. 4B similarly illustrates features of the cartridge 204, such as the flow paths 404, the contact surfaces 400, and the like. In this example, the flow paths 404 are aligned with the contact surfaces 400, but as discussed herein, different configurations may include different alignments between components based on various design considerations.

Figure 5A:
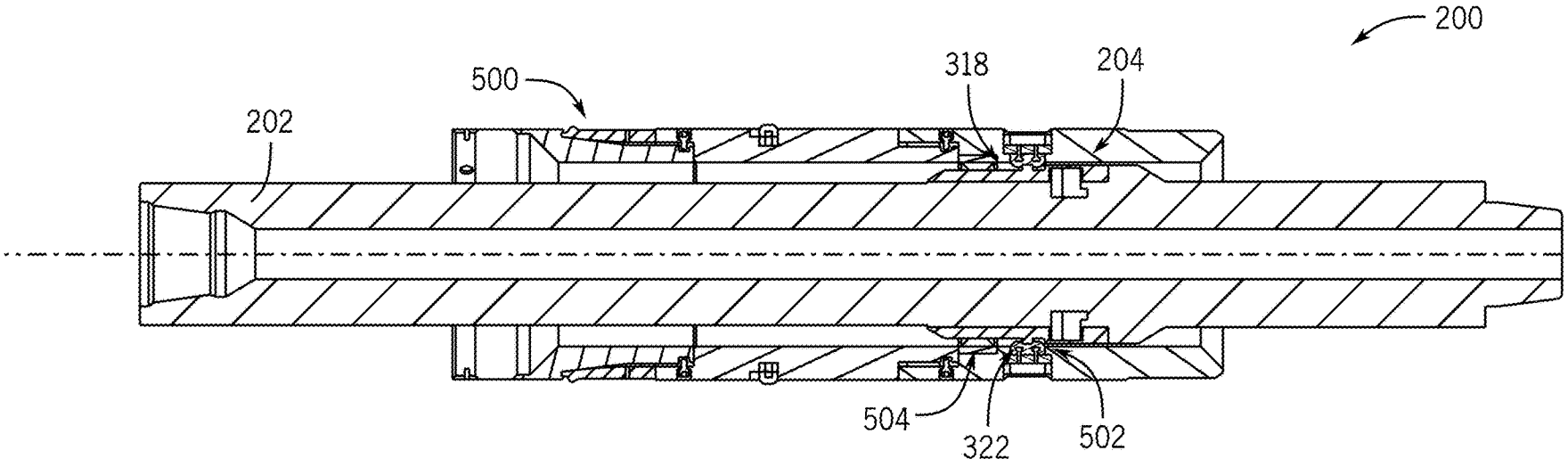
FIG. 5A illustrates a cross-sectional view of an embodiment a wellbore component coupled to a cartridge secured to a running tool, in accordance with embodiments of the present disclosure.
Figure 5B:
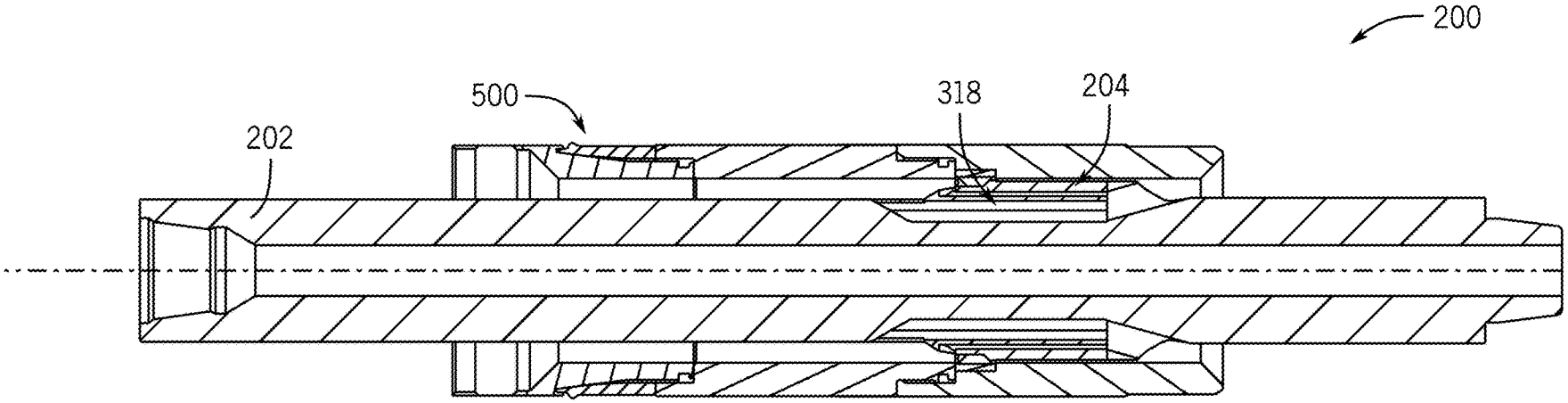
FIG. 5B illustrates a cross-sectional view of an embodiment a wellbore component coupled to a cartridge secured to a running tool, in accordance with embodiments of the present disclosure.

FIGS. 5A and 5B illustrate cross-sectional views of embodiments of the BRRT 200 coupled to a wear bushing assembly 500. In this example, the wear bushing assembly 500 is positioned circumferentially about the RT 200 such that respective axes are aligned with the tool axis 206. As shown, the wear bushing assembly 500 includes a series of connecting elements to engage one or more portions of the cartridge 204. In at least one embodiment, the cartridge 204 may be used to both protect the RT 202 during operations and also engage the wear bushing assembly 500 for installation and/or retrieval.

In this example, the wear bushing includes a set of dogs 502 that are used to engage the coupling slot 322, for example during installation for stabilization and centralization. The dogs 502 may be spring-loaded and extend radially inward (e.g., toward the tool axis 206) to engage the coupling slot 322 when the coupling slot 322 is aligned with the dogs 502. For example, in at least one embodiment, the wear bushing assembly 500 may be coupled to the cartridge 204 such that the dogs 502 engage the coupling slot 322. The wear bushing assembly 500 may also be coupled with one or more additional elements. The BRRT 200 may then position the wear bushing assembly 500 at a desired location and, upon rotation, may disengage the dogs 502 from the coupling slot 322, thereby allowing removal of the BRRT 200 while the wear bushing assembly 500 remains in the wellbore. For retrieval, the BRRT 200 may be tripped into the wellbore and then the retrieval shoulder 318 may be used to engage one or more recovery overhangs 504 of the wear bushing assembly 500. In this manner, the cartridge 204 is used in both installation and retrieval operations. FIG. 5B further illustrates engagement between the one or more recovery overhangs 504 and the retrieval shoulder 318. Additionally, the flow paths 404 are also illustrated extending into the cartridge 204 and coupled to the flow by passages 402.

Figure 5C:
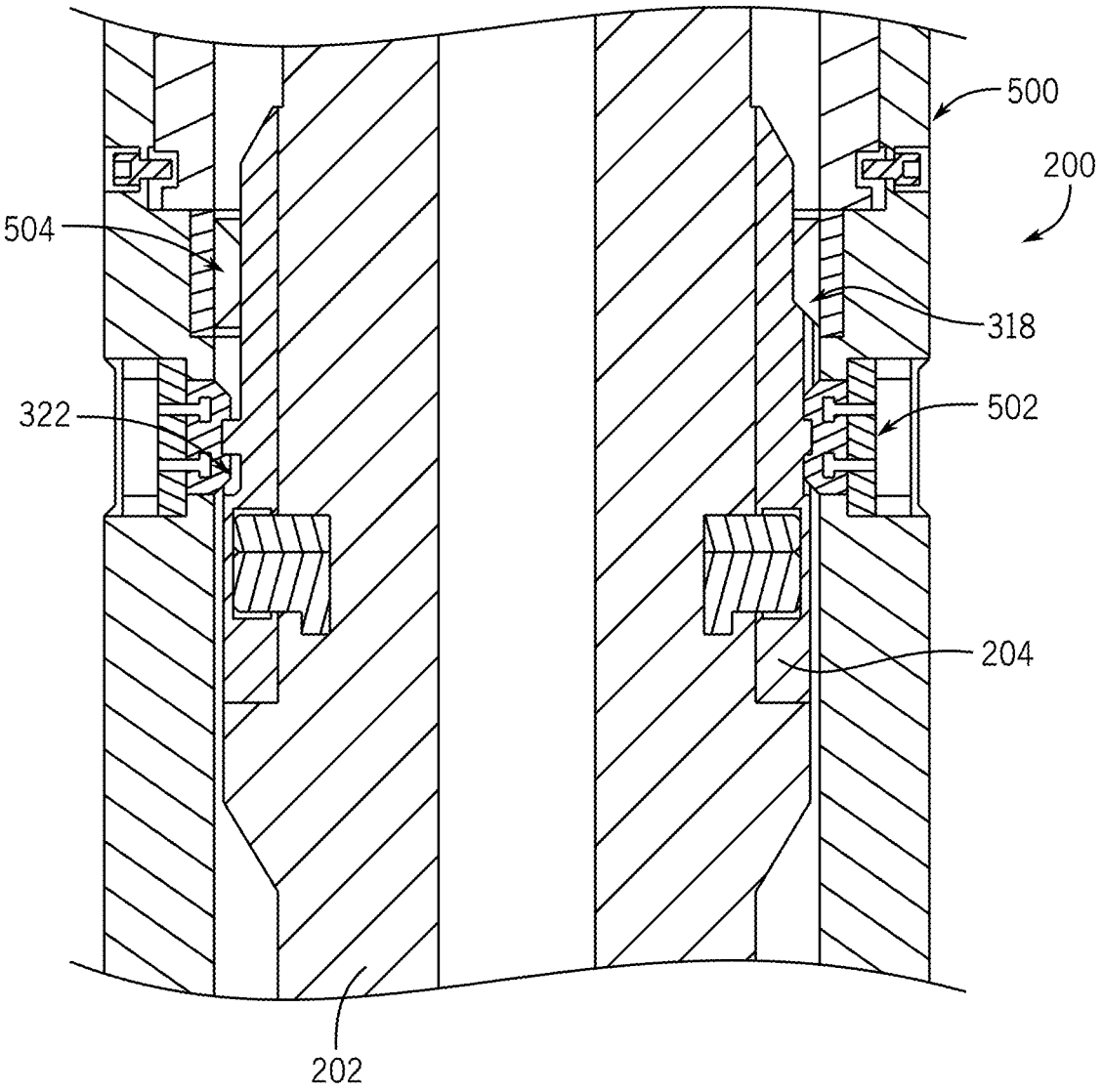
FIG. 5C illustrates a detailed cross-sectional view of an embodiment a wellbore component coupled to a cartridge secured to a running tool, in accordance with embodiments of the present disclosure.
Figure 5D:
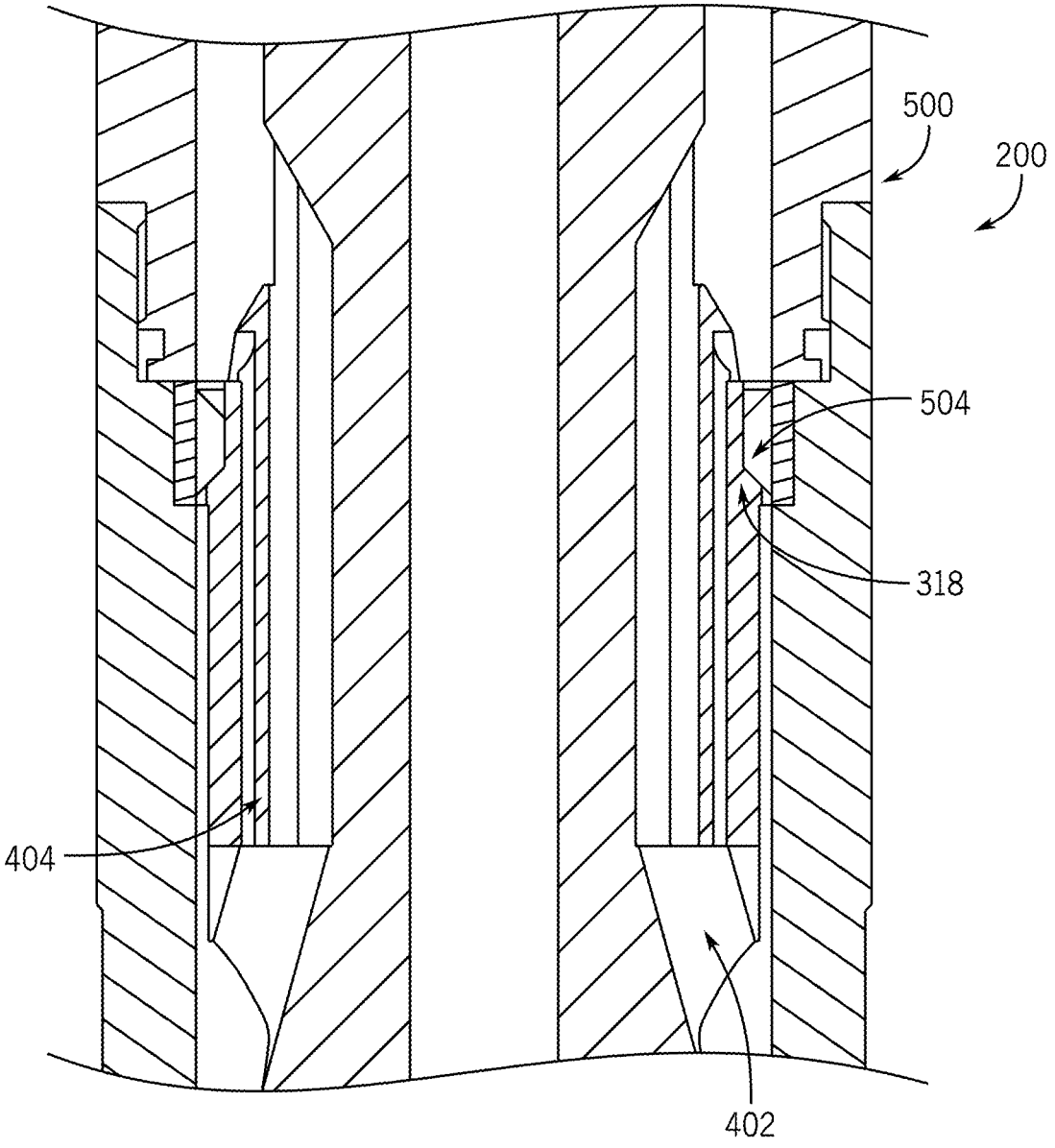
FIG. 5D illustrates a detailed cross-sectional view of an embodiment a wellbore component coupled to a cartridge secured to a running tool, in accordance with embodiments of the present disclosure.

FIGS. 5C and 5D are detailed cross-sectional views of the interactions between the wear bushing assembly 500 and the cartridge 204. As discussed herein, the dogs 502 may be activated (e.g., spring loaded) to drive radially inward toward the axis 206 to engage the coupling slots 322. The dogs 502 may not be used for retrieval purposes, or may be used in addition to other components, to increase a likelihood of retrieval by not relying solely on a spring-loaded connection. However, in other embodiments, different coupling mechanisms may be used for the dogs 502 and such mechanisms may be sufficient for retrieval operations. The dogs 502 may engage the coupling slots 322 while in an aligned or predetermined position and then disengage with rotation or other movement of the BRRT 200, which may cause movement of the cartridge 204. For example, the cartridge 204 may be rotated, along with the BRRT 200, so that the force of the springs for the dogs 502 are overcome, thereby causing the dogs to retreat radially outward and away from the cartridge 204.

In this example, the recovery overhang 504 is positioned proximate the retrieval shoulder 318. It should be appreciated that the configuration is shown as an example of component alignment and that, during recovery, the dogs 502 may be disengaged. In operation, an upward force on the BRRT 200 will drive the retrieval shoulder 318 into the recovery overhang 504, thereby applying a force to lift the wear bushing assembly 500 and carry the wear bushing assembly 500 out of the wellbore. Additionally, FIG. 5D illustrates the alignment between the flow path 404 and the flow by 402, thereby permitting flow along the RT 202 and through the cartridge 204.

As discussed herein, the dogs 502 of this example include an opening or recess configured to engage the geometry of the associated coupling slot 322. The geometry of the dogs 502 and/or the coupling slot 322 may be particularly selected based on design considerations and/or in order to accommodate different tools or other components, thereby providing a universal design for the cartridge 204 that may accommodate tools from a variety of different manufacturers. For example, the coupling slot 322 may be designed to accommodate specific types of tools for a specific manufacturer, and as a result, different geometric configurations of the coupling slot 322 may be tuned or otherwise selected to received supporting components, such as the dogs 502. However, if another manufacturer were to form the wear bushing assembly 500, as one non-limiting example, the configuration of the coupling slot 322 may be changed in order to accommodate a different dog 502 configuration. Accordingly, systems and methods of the present disclosure may be adaptable based on mating configurations for other wellbore components.

Figure 6:
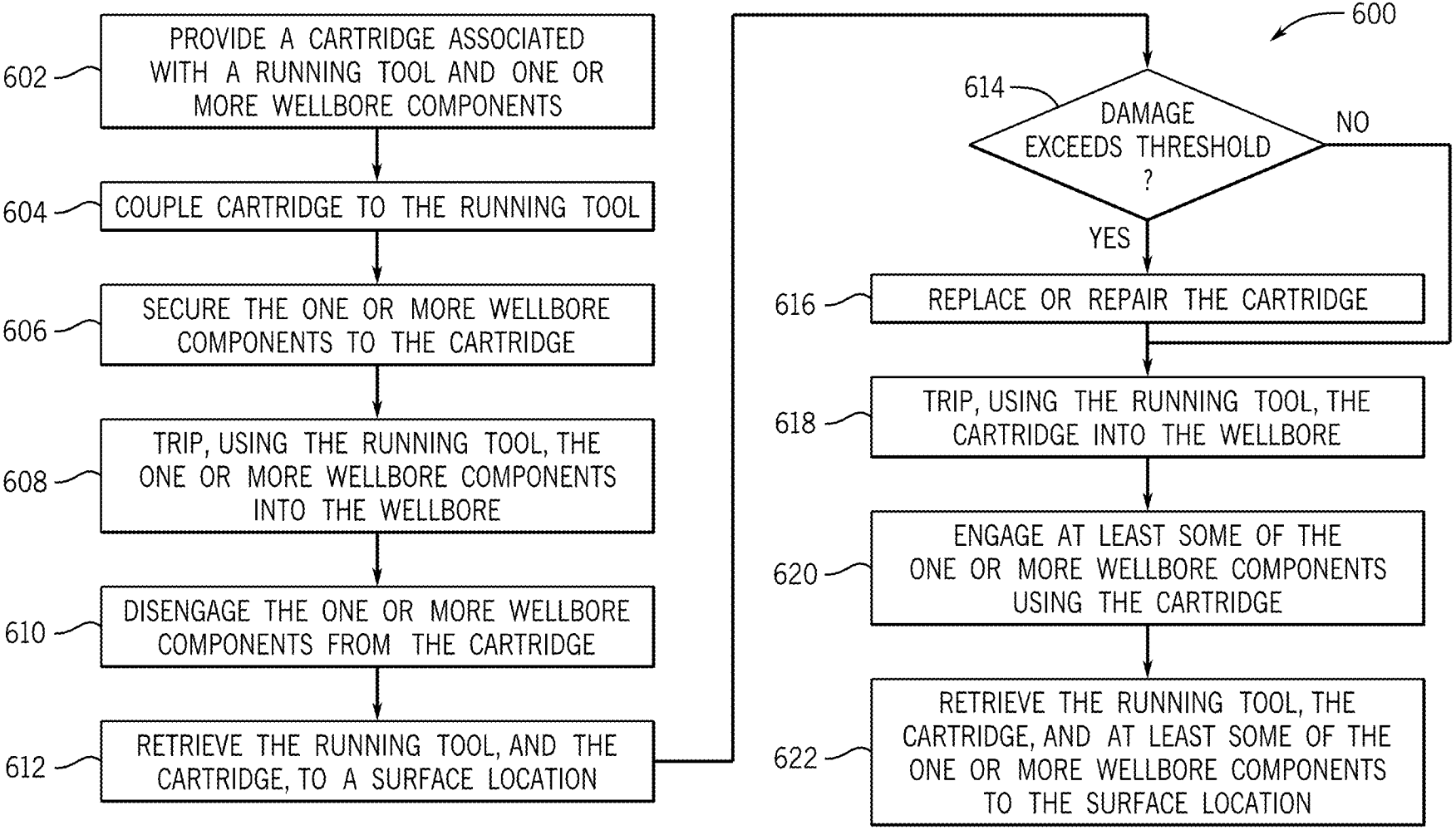
FIG. 6 illustrates a flow chart of an example process for performing one or more wellbore operations, in accordance with embodiments of the present disclosure.

FIG. 6 illustrates an example flow chart for an example process 600 that may be used with embodiments of the present disclosure. It should be understood that for this and other processes presented herein that there can be additional, fewer, or alternative operations performed in similar or alternative order, or at least partially in parallel, within the scope of various embodiments unless otherwise specifically stated. In this example, a cartridge is provided for use with one or more tools, such as a running tool 602. In at least one embodiment, the cartridge includes dimensions or other features for use with one or more particular tools. For example, the cartridge may include features to engage with a wellbore component, such as a wear bushing assembly, and may further include one or more replaceable or insertable components to adapt to a variety of different tool or component configurations.

The cartridge may be coupled and/or secured to the running tool 604 Securing the cartridge to the running tool may include using one or more fasteners and/or keys, as discussed herein. The keys may be used to prevent loading of the fasteners, for example by providing keys with particular configurations for load distribution purposes. The keys may extend through one or more openings formed in the cartridge and into one or more slots associated with the running tool. In at least one embodiment, alignment between the running tool slots and the openings may permit insertion of the keys, while misalignment may prevent insertion. The keys may be further secured to the running tool using one or more fasteners, as well as various other coupling devices.

In at least one embodiment, one or more wellbore components may be coupled to the cartridge 606. For example, embodiments herein describe a wear bushing assembly as a non-limiting example. Various portions of the cartridge may include profiles to accommodate particular wellbore components, for example by including slots, mating surfaces, and/or the like. The assembly of the running tool, cartridge, and wellbore components may be tripped into the wellbore 608 and the running tool may be used to cause the cartridge to disengage from the one or more wellbore components 610. For example, the running tool may be rotated, which may cause rotation of the cartridge due to the connection between the two, and then the cartridge may disengage from the one or more wellbore components. After disengaging the cartridge and the running tool from the one or more wellbore components, different downhole operations may be performed. For example, a drilling operation may be performed. The running tool and the cartridge may be tripped back up and retrieved at a surface location 612. It should be appreciated that the return trip may be performed at a variety of different times, and discussion of tripping after a drilling operation is by way of non-limiting example only.

As discussed herein, the cartridge may include one or more surfaces, such as a 360 degree annular surface, that is used to engage the wellbore wall to block contact with the running tool. The cartridge may be inspected and it may be determined whether damage exceeds a threshold 614. If so, the cartridge may be repaired or replaced 616, for example by swapping out a spare. Thereafter, the running tool and cartridge may be tripped back into the wellbore 618 and used to engaged at least some of the one or more wellbore portions 620. For example, a retrieval shoulder of the cartridge may engage an overhang to remove one or more wellbore components. The running tool, cartridge, and the engaged one or more wellbore components may then be retrieved as the surface location 622.

Embodiments may also be described in view of the following clauses:

1. A wellbore system, comprising:
a running tool, comprising:
a slot extending radially into the running tool; and
a load shoulder; and
a cartridge configured to couple to the running tool, the cartridge circumferentially surrounding the running tool about a tool axis, the cartridge comprising:
an opening extending radially into the cartridge;
a coupling slot arranged along an outer profile of the cartridge; and
a contact face arranged along the outer profile of the cartridge;
wherein the cartridge is positioned on the load shoulder such that the load shoulder blocks axial downward movement of the cartridge along the tool axis and the cartridge is coupled to the running tool via one or more keys extending into both the opening and the slot.
2. The wellbore system of clause 1, wherein the opening is aligned with the slot.
3. The wellbore system of clause 1, further comprising:
a flow by passage formed along the running tool; and
a flow path formed along the cartridge, wherein the flow by passage is aligned with the flow path when the cartridge is coupled to the running tool.
4. The wellbore system of clause 1, wherein the contact face has a larger contact face outer diameter than a load shoulder outer diameter.
5. The wellbore system of clause 1, wherein the slot includes a first portion extending radially into the running tool and a second portion extending axially downward from the first portion.
6. The wellbore system of clause 5, wherein the one or more keys comprise:
a first key portion that engages the first portion of the slot; and
a second key portion that engages the second portion of the slot.
7. The wellbore system of clause 1, wherein the contact face further comprises a surface treatment.
8. The wellbore system of clause 1, wherein the coupling slot is configured to receive a mating article associated with one or more wellbore components to couple the one or more wellbore components to the running tool.
9. The wellbore system of clause 1, wherein the cartridge is a unitary component and the contact face extends for 360 degrees about the tool axis.
10. A cartridge for a running tool, comprising:
a retrieval shoulder configured to engage one or more wellbore components to remove the one or more wellbore components from a wellbore;
a coupling slot, axially lower than the retrieval shoulder, configured to receive one or more mating features associated with the one or more wellbore components;
an opening extending into a body of the cartridge; and
a contact surface extending a contact distance from an axis of the cartridge that is larger than a retrieval distance between the retrieval shoulder and the axis of the cartridge and a coupling distance between the coupling slot and the axis of the cartridge, wherein the opening is configured to receive one or more keys to secure the cartridge to the running tool and the contact surface is a continuous surface formed about the axis of the cartridge.

11. The cartridge of clause 10, wherein the contact surface includes a lower portion that is configured to sit on a cartridge surface of the running tool.

12. The cartridge of clause 10, further comprising:

one or more flow paths, formed along an inner diameter of the cartridge, the one or more flow paths configured to align with flow by passages of the running tool.

13. The cartridge of clause 10, wherein the contact surface extends for an axial length that is greater than the coupling slot and the opening.

14. The cartridge of clause 10, wherein at least a portion of the contact surface includes a surface treatment.

15. The cartridge of clause 10, further comprising:

a plurality of coupling slots, including the coupling slot, positioned at different circumferential positions about the cartridge; and a plurality of openings, including the opening, positioned at different circumferential positions about the cartridge.

16. The cartridge of clause 15, wherein each coupling slot of the plurality of coupling slots is aligned with a respective opening of the plurality of openings.

17. A wellbore system, comprising:

a running tool;

one or more wellbore components to be installed into a wellbore using the running tool; and a cartridge configured to couple to the running tool, the cartridge comprising:

an opening extending radially into the cartridge, the opening configured to align with a slot formed in the running tool to couple the cartridge to the running tool;

a retrieval shoulder arranged along an outer portion of the cartridge to engage at least a portion of the one or more wellbore components to remove the one or more wellbore components from the wellbore;

a coupling slot configured to couple to one or more features of the one or more wellbore components to install the one or more wellbore components into the wellbore; and a contact face forming a largest outer diameter of the cartridge and circumferentially surrounding the running tool.

18. The wellbore system of clause 17, further comprising:

a load shoulder formed on the running tool to receive and support the cartridge.

19. The wellbore system of clause 17, wherein the contact face extends farther radially outward from an axis of the running tool than a largest outer diameter of the running tool.

20. The wellbore system of clause 17, wherein one or more keys are configured to engage the opening and the slot.

21. A wellbore system, comprising:

a running tool, comprising:

a slot extending radially into the running tool; and a load shoulder; and a cartridge configured to couple to the running tool, the cartridge circumferentially surrounding the running tool about a tool axis, the cartridge comprising:

an opening extending radially into the cartridge;

a coupling slot arranged along an outer profile of the cartridge; and a contact face arranged along the outer profile of the cartridge;

wherein the cartridge is positioned on the load shoulder such that the load shoulder blocks axial downward movement of the cartridge along the tool axis and the cartridge is coupled to the running tool via one or more keys extending into both the opening and the slot.

22. The wellbore system of clause 21, wherein the opening is aligned with the slot.

23. The wellbore system of any of clauses 21 or 22, further comprising:

a flow by passage formed along the running tool; and a flow path formed along the cartridge, wherein the flow by passage is aligned with the flow path when the cartridge is coupled to the running tool.

24. The wellbore system of any of clauses 21-23, wherein the contact face has a larger contact face outer diameter than a load shoulder outer diameter.

25. The wellbore system of any of clauses 21-24, wherein the slot includes a first portion extending radially into the running tool and a second portion extending axially downward from the first portion.

26. The wellbore system of clause 25, wherein the one or more keys comprise:

a first key portion that engages the first portion of the slot; and a second key portion that engages the second portion of the slot.

27. The wellbore system of any of clauses 21-26, wherein the contact face further comprises a surface treatment.

28. The wellbore system of any of clause 21-27, wherein the coupling slot is configured to receive a mating article associated with one or more wellbore components to couple the one or more wellbore components to the running tool.

29. The wellbore system of any of clauses 21-28, wherein the cartridge is a unitary component and the contact face extends for 360 degrees about the tool axis.

30. A cartridge for a running tool, comprising:

a retrieval shoulder configured to engage one or more wellbore components to remove the one or more wellbore components from a wellbore;

a coupling slot, axially lower than the retrieval shoulder, configured to receive one or more mating features associated with the one or more wellbore components;

an opening extending into a body of the cartridge; and a contact surface extending a contact distance from an axis of the cartridge that is larger than a retrieval distance between the retrieval shoulder and the axis of the cartridge and a coupling distance between the coupling slot and the axis of the cartridge, wherein the opening is configured to receive one or more keys to secure the cartridge to the running tool and the contact surface is a continuous surface formed about the axis of the cartridge.

31. The cartridge of clause 30, wherein the contact surface includes a lower portion that is configured to sit on a cartridge surface of the running tool.

32. The cartridge of any of clauses 30 or 31, further comprising:

one or more flow paths, formed along an inner diameter of the cartridge, the one or more flow paths configured to align with flow by passages of the running tool.

33 The cartridge of any of clauses 30-32, wherein the contact surface extends for an axial length that is greater than the coupling slot and the opening.

34. The cartridge of any of clauses 30-33, wherein at least a portion of the contact surface includes a surface treatment.

35. The cartridge of any of clauses 30-34, further comprising:

a plurality of coupling slots, including the coupling slot, positioned at different circumferential positions about the cartridge; and a plurality of openings, including the opening, positioned at different circumferential positions about the cartridge.

36. The cartridge of clause 35, wherein each coupling slot of the plurality of coupling slots is aligned with a respective opening of the plurality of openings.

37. A wellbore system, comprising:

a running tool;

one or more wellbore components to be installed into a wellbore using the running tool; and a cartridge configured to couple to the running tool, the cartridge comprising:

an opening extending radially into the cartridge, the opening configured to align with a slot formed in the running tool to couple the cartridge to the running tool;

a retrieval shoulder arranged along an outer portion of the cartridge to engage at least a portion of the one or more wellbore components to remove the one or more wellbore components from the wellbore;

a coupling slot configured to couple to one or more features of the one or more wellbore components to install the one or more wellbore components into the wellbore; and a contact face forming a largest outer diameter of the cartridge and circumferentially surrounding the running tool.

38. The wellbore system of clause 37, further comprising:

a load shoulder formed on the running tool to receive and support the cartridge.

39. The wellbore system of any of clauses 37 or 38, wherein the contact face extends farther radially outward from an axis of the running tool than a largest outer diameter of the running tool.

40. The wellbore system of any of clauses 37-39, wherein one or more keys are configured to engage the opening and the slot.

The foregoing disclosure and description of the disclosed embodiments is illustrative and explanatory of the embodiments of the disclosure. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A cartridge for retrieving one or more wellbore components, comprising:

a bore extending through a body of the cartridge;

a retrieval shoulder configured to engage the one or more wellbore components to remove the one or more wellbore components from a wellbore;

a coupling slot, axially lower than the retrieval shoulder, configured to receive one or more mating features associated with the one or more wellbore components;

a contact surface extending a contact distance from an axis of the cartridge that is larger than a retrieval distance between the retrieval shoulder and the axis of the cartridge and a coupling distance between the coupling slot and the axis of the cartridge; and one or more axial flow paths formed through the body of the cartridge.

2. The cartridge of claim 1, further comprising:

an opening extending into the body of the cartridge, wherein the opening is configured to receive one or more keys to secure the cartridge to a running tool.

3. The cartridge of claim 1, wherein the one or more axial flow paths are formed along an inner diameter of the cartridge.

4. The cartridge of claim 3, wherein the one or more axial flow paths are configured to align with flow by passages of a running tool coupled to the cartridge.

5. The cartridge of claim 1, wherein the contact surface includes a lower portion that is configured to sit on a cartridge surface of a running tool.

6. The cartridge of claim 1, wherein the contact surface extends for an axial length that is greater than the coupling slot.

7. The cartridge of claim 1, wherein at least a portion of the contact surface includes a surface treatment.

8. The cartridge of claim 1, further comprising:

a plurality of coupling slots, including the coupling slot, positioned at different circumferential positions about the cartridge.

9. The cartridge of claim 1, wherein the cartridge is a unitary component.

10. A wellbore system, comprising:

a running tool comprising:

a load shoulder; and a flow by passage formed along the running tool; and a cartridge positioned on the load shoulder such that the load shoulder blocks axial downward movement of the cartridge along a tool axis, the cartridge circumferentially surrounding the running tool about the tool axis, the cartridge comprising:

a coupling slot arranged along an outer profile of the cartridge;

a contact face arranged along the outer profile of the cartridge; and an axial flow path;

wherein the flow by passage is aligned with the axial flow path when the cartridge is coupled to the running tool.

11. The wellbore system of claim 10, further comprising:

a slot extending radially into the running tool; and an opening extending radially into the cartridge, wherein the cartridge is coupled to the running tool via one or more keys extending into both the opening and the slot.

12. The wellbore system of claim 11, wherein the opening is aligned with the slot.

13. The wellbore system of claim 11, wherein the slot includes a first portion extending radially into the running tool and a second portion extending axially downward from the first portion.

14. The wellbore system of claim 11, wherein the one or more keys comprise:

a first key portion that engages the first portion of the slot; and a second key portion that engages the second portion of the slot.

15. The wellbore system of claim 10, wherein the contact face further comprises a surface treatment.

16. The wellbore system of claim 10, wherein the coupling slot is configured to receive a mating article associated with one or more wellbore components to couple the one or more wellbore components to the running tool.

17. The wellbore system of claim 10, wherein the cartridge is a unitary component.

18. A wellbore system, comprising:

a running tool;

one or more wellbore components to be installed into a wellbore using the running tool; and a cartridge configured to couple to the running tool, the cartridge comprising:

a bore extending through a body of the cartridge;

a retrieval shoulder arranged along an outer portion of the cartridge to engage at least a portion of the one or more wellbore components to remove the one or more wellbore components from the wellbore;

a coupling slot configured to couple to one or more features of the one or more wellbore components to install the one or more wellbore components into the wellbore;

a contact face forming a largest outer diameter of the cartridge and circumferentially surrounding the running tool; and one or more axial flow paths formed through the body of the cartridge.

19. The wellbore system of claim 18, further comprising:

a flow by passage formed along the running tool, wherein the flow by passage is aligned with the one or more axial flow paths when the cartridge is coupled to the running tool.

20. The wellbore system of claim 18, further comprising:

an opening extending radially into the cartridge, the opening configured to align with a slot formed in the running tool to couple the cartridge to the running tool; and a load shoulder formed on the running tool to receive and support the cartridge.

* * * * *